US008852008B2

(12) United States Patent
Chen

(10) Patent No.: US 8,852,008 B2
(45) Date of Patent: Oct. 7, 2014

(54) RAMP SYSTEM FOR EXTREME SPORTS

(71) Applicant: Wang-Chuan Chen, Taichung (TW)

(72) Inventor: Wang-Chuan Chen, Taichung (TW)

( * ) Notice: Subject to any disclaimer, the term of this patent is extended or adjusted under 35 U.S.C. 154(b) by 81 days.

(21) Appl. No.: 13/646,347

(22) Filed: Oct. 5, 2012

(65) Prior Publication Data

US 2014/0100045 A1 Apr. 10, 2014

(51) Int. Cl.
*A63C 19/10* (2006.01)
*A63C 19/00* (2006.01)

(52) U.S. Cl.
USPC ..... 472/89; 14/69.5

(58) Field of Classification Search
CPC ..... B65G 69/28; B65G 69/30; A63C 17/00; A63C 17/02; A63C 17/04; A63C 17/06; A63C 17/10; A63C 17/22; A63C 19/00; A63C 19/10
USPC ..... 472/88–90; 14/2.4, 2.5, 69.5
See application file for complete search history.

(56) References Cited

U.S. PATENT DOCUMENTS

| | | | | |
|---|---|---|---|---|
| 6,119,634 | A * | 9/2000 | Myrick | 119/847 |
| 6,695,707 | B1 * | 2/2004 | Fernandez et al. | 472/89 |
| 7,526,826 | B2 * | 5/2009 | Bailie | 14/69.5 |
| 2005/0075177 | A1 * | 4/2005 | Bork et al. | 472/89 |

* cited by examiner

*Primary Examiner* — Kien Nguyen
(74) *Attorney, Agent, or Firm* — Muncy, Geissler, Olds & Lowe, P.C.

(57) ABSTRACT

A ramp system includes at least one ramp component. Each ramp component includes a front surface provided a user sliding thereon and a back surface opposite to the front surface and facing to the ground. The at least one ramp component each has a connecting portion including at least one connecting block and at least one connecting recess spaced by the connecting block. The at least one connecting block and the at least one connecting recess can be assembled with that of other ramp components at random to create a skating facility. These ramp components are easily assembled for use and disassembled for storage and transport.

12 Claims, 11 Drawing Sheets

RAMP SYSTEM FOR EXTREME SPORTS

BACKGROUND OF THE INVENTION

1. Field of the Invention

The present invention relates generally to a ramp system with modular components and, more particularly, to a ramp system for extreme sports such as skateboarding, inline skating, bicycle riding, snowboarding, snowskating and other related sport activities.

2. Description of the Related Art

Extreme sports ramps are used in gravity extreme sports such as snowboarding, skateboarding, skiing, freestyle BMX, and inline skating to enable participants to do tricks and to apply controlled upward and downward force along with lateral movement and force. The ramps applications include leisure recreation, skills development, competitive training, amateur and professional competition, demonstrations, and as an adjunct to other types of skills training. A skilled athlete can perform in a ramp for an extended period of time by pumping to attain extreme speeds with relatively little effort. Large ramp makes possible many of the aerial tricks in BMX, inline skating and skateboarding.

However, currently utilized structures range from a board elevated at one end used by beginners to large bulky completely pre-assembled and very heavy one-piece structures. For professionals, it is not unusual for exhibitors of professional talent to carry a crew of carpenters to build structures utilized for performing stunts, as welt as to build practice ramps. The large ramp is a complete unit, with a big volume, and cannot be contracted and folded, causing inconvenience to packaging and delivery of the ramp. Moreover, because it is big volume, it is not able to be lengthened, thus limits jump-over height of the skaters, shortens their action time in the air and finally impacts the quality of their performance in the air.

The present invention is, therefore, intended to obviate or at least alleviate the problems encountered in the prior art.

SUMMARY OF THE INVENTION

The present invention solves this need and other problems in the field of ramp system for extreme sports by providing at least one ramp component to each including a curved slope and a front surface provided a user sliding thereon and a back surface opposite to the front surface and facing to the ground. The at least one ramp component each includes a first end adapted for standing on the ground and a second end opposite to the first end. First and second side ends respectively extend between the first and second ends. The at least one ramp component each has a connecting portion at the second end. Moreover, the connecting portion includes at least one connecting block and at least one connecting recess spaced by the connecting block. The at least one connecting block and the at least one connecting recess are alternately arranged and extended from the first side end to the second side end. Furthermore, the front and back surfaces form an included angle at the first end, with a contact edge formed between the front and back surfaces, with a contact surface formed at the first end and adjacent the back surface and adapted for abutting the ground.

Preferably, the ramp components may be releasably assembled together in a variety of ways to create a skating facility. These ramp components are easily assembled for use and disassembled for storage and transport.

The ramp components are made with a modular design thereby causing efficient manufacturing operation and reducing manufacturing cost.

Moreover, spines are respectively received into grooves of the ramp components, and adapted for the user performing a variety of tricks thereon.

Furthermore, a plurality of convex portions and a plurality of engaging holes of the ramp components selectively engage together to allow a plurality of ramp components to be assembled together side-to-side to create a wider ramp system for users.

Additionally, the ramp components are connected together by fasteners and second fixing members to provide high connection strength.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

Figure 1:
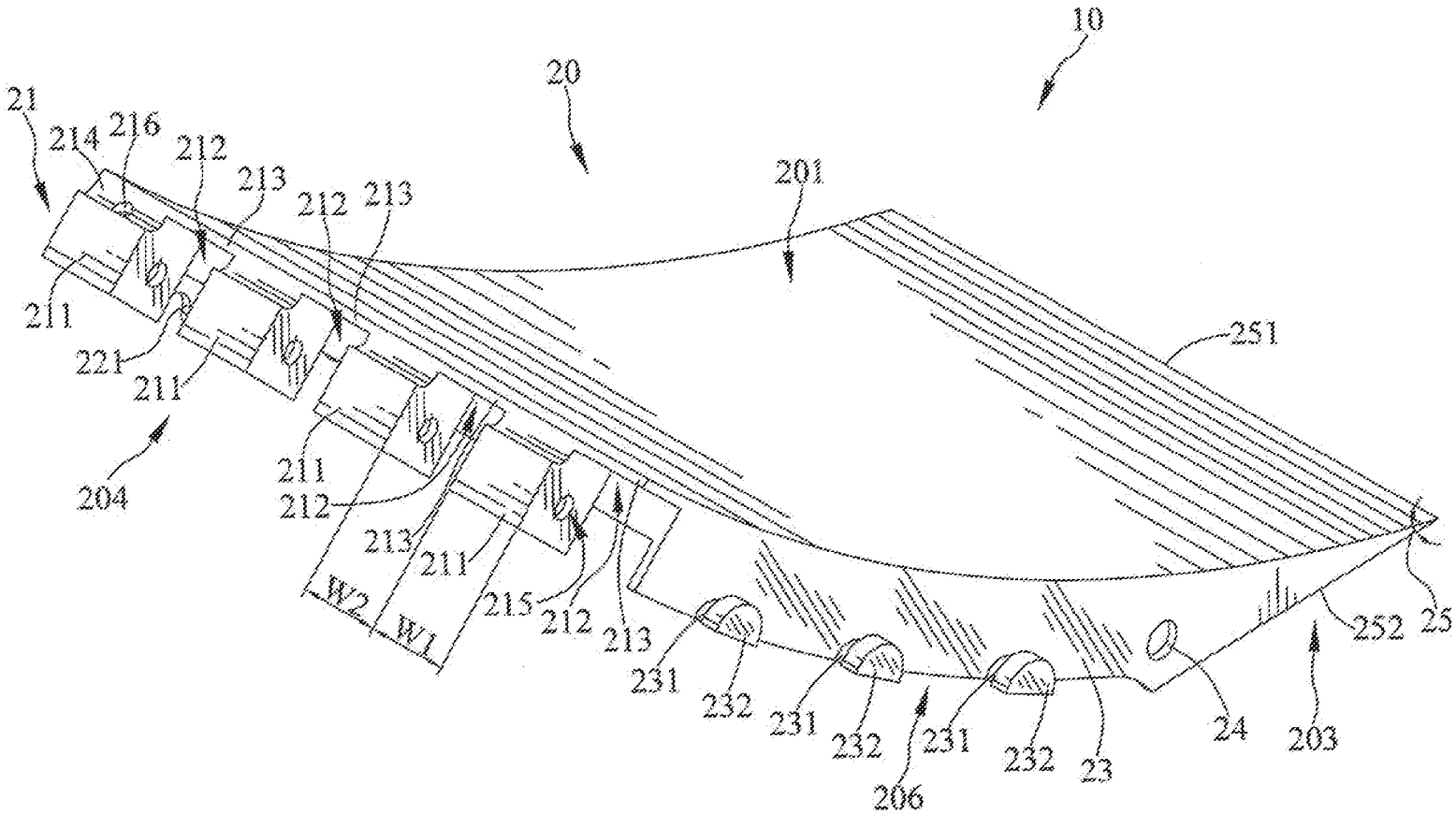
FIG. 1 shows a perspective view of a ramp system according to the present invention and illustrates the ramp system including a first ramp component.
Figure 2:
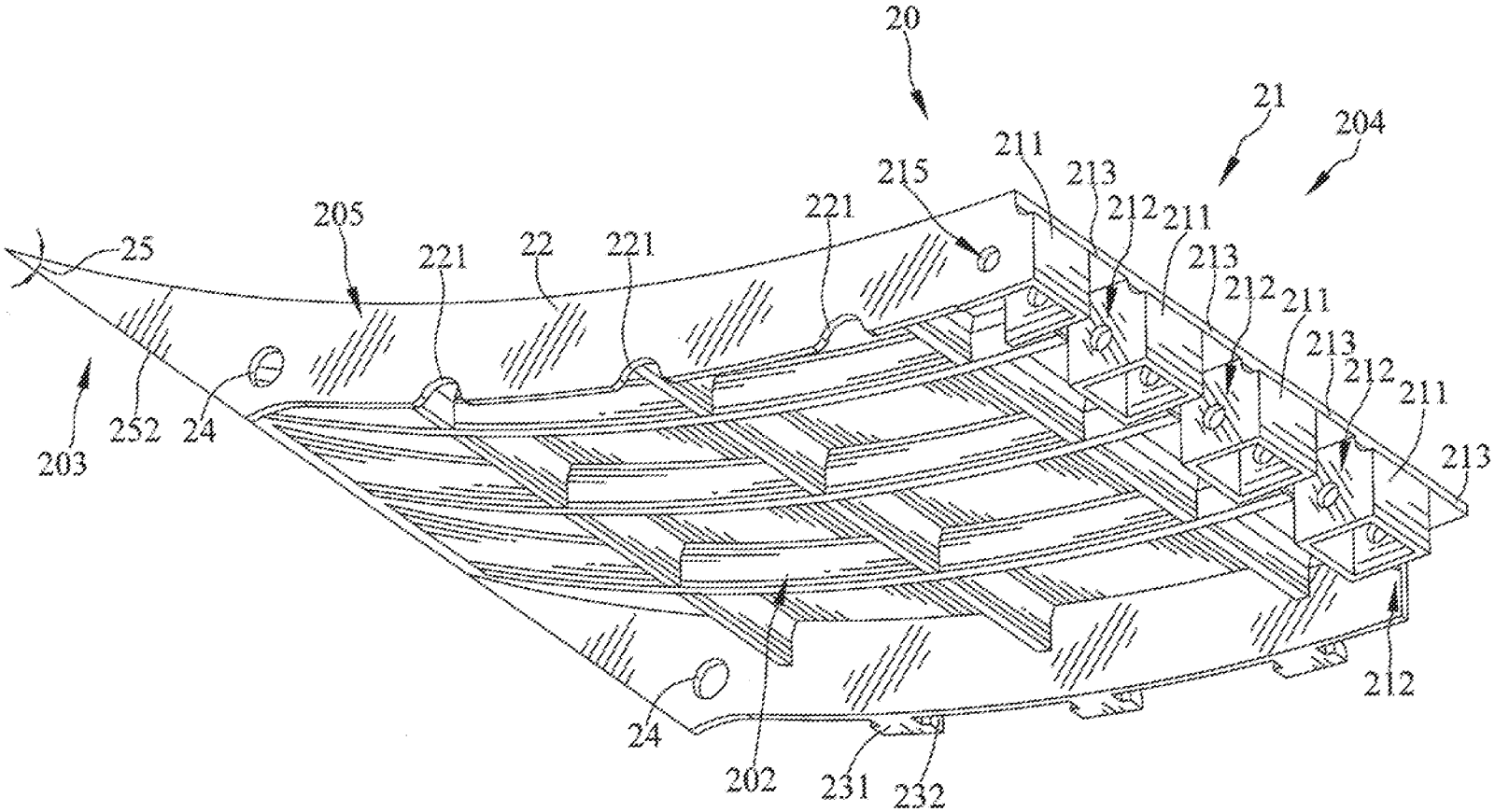
FIG. 2 shows another perspective view of the ramp system of FIG. 1.
Figure 3:
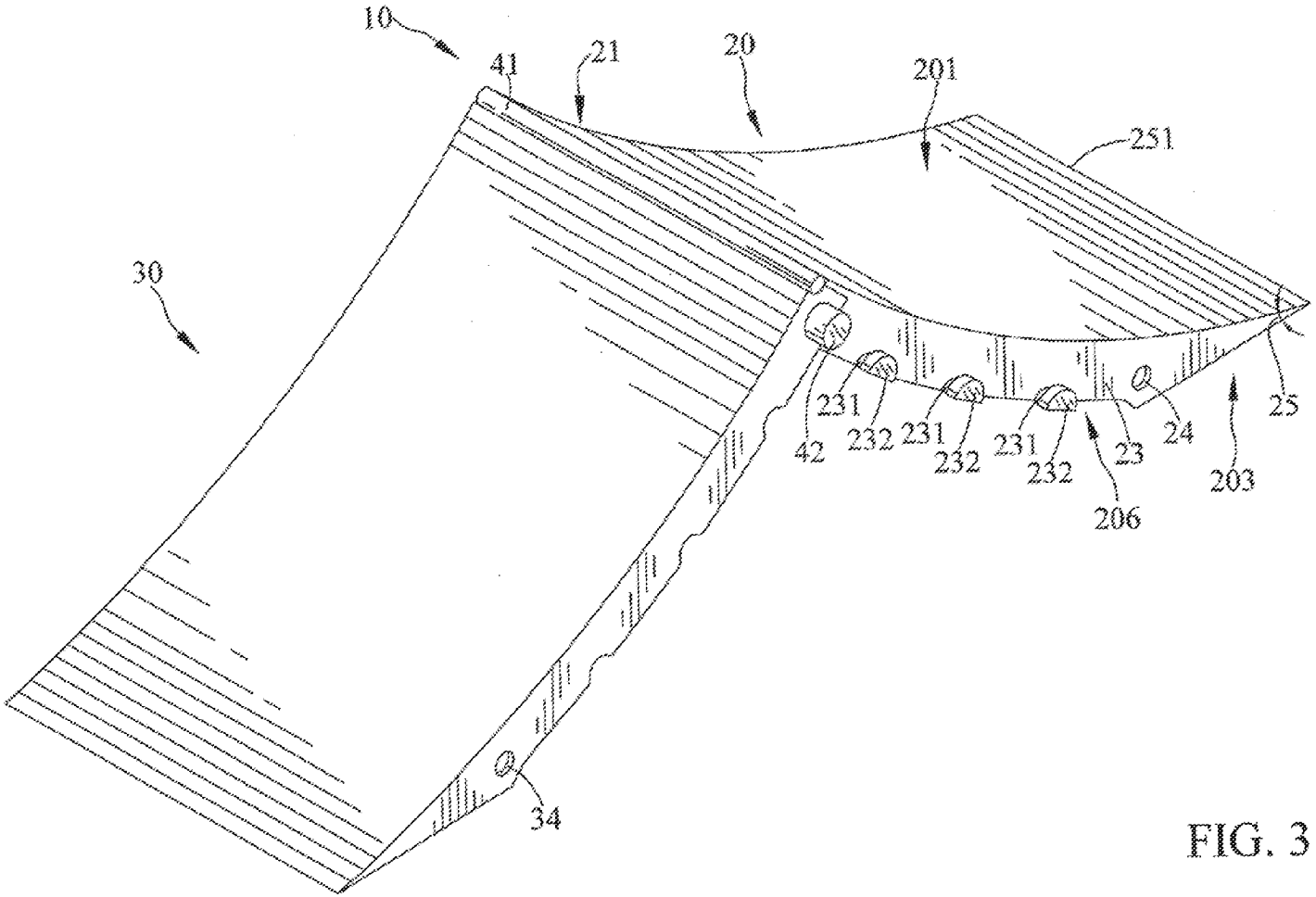
FIG. 3 shows a perspective view of the ramp system of FIG. 1 and illustrates the first ramp component connected with a second ramp component.
Figure 4:
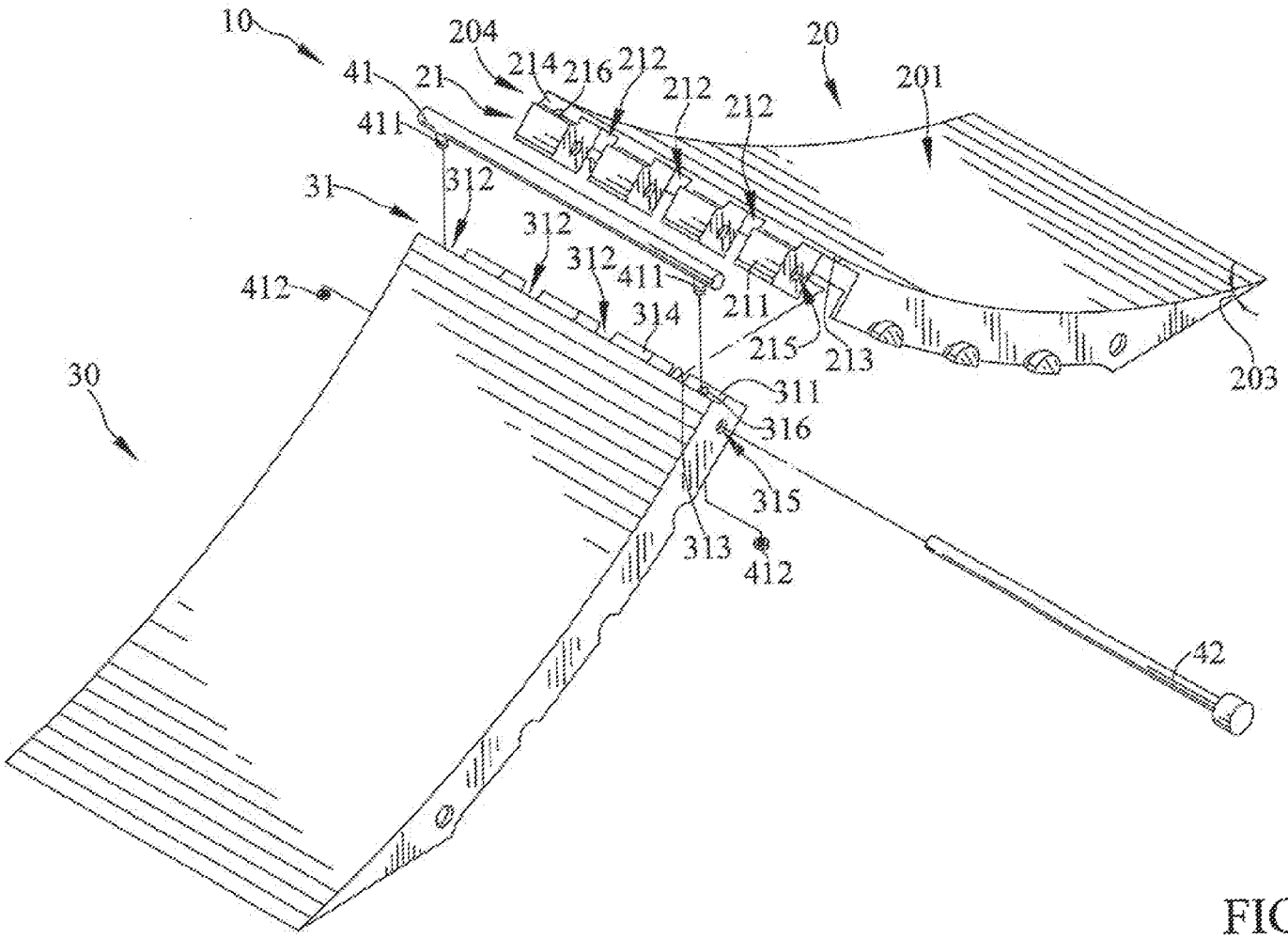
FIG. 4 shows an exploded, perspective view of the ramp system of FIG. 3.
Figure 5:
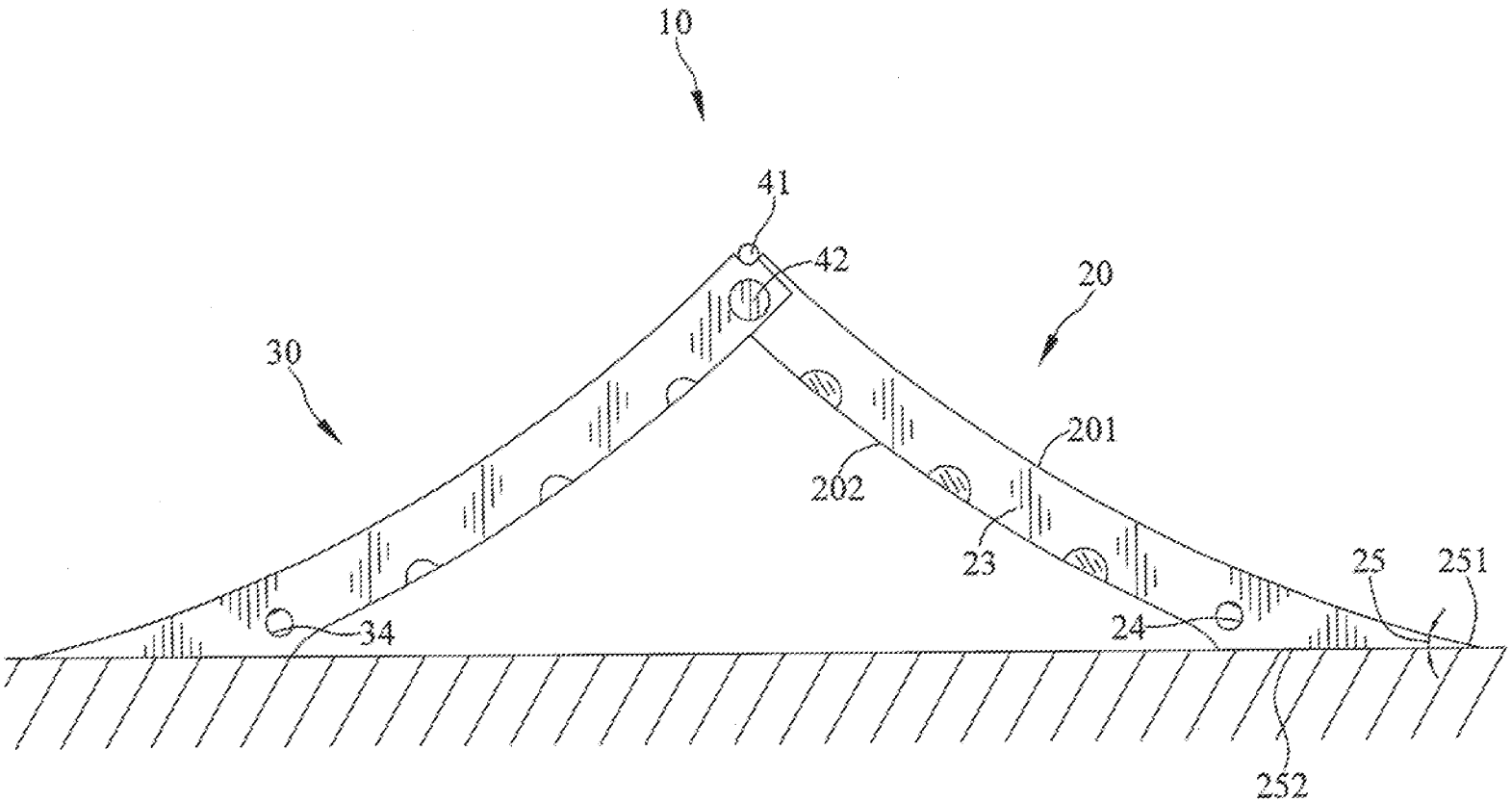
FIG. 5 shows a perspective view of the ramp system of FIG. 3 and illustrates the first and second ramp components in operation.
Figure 6:
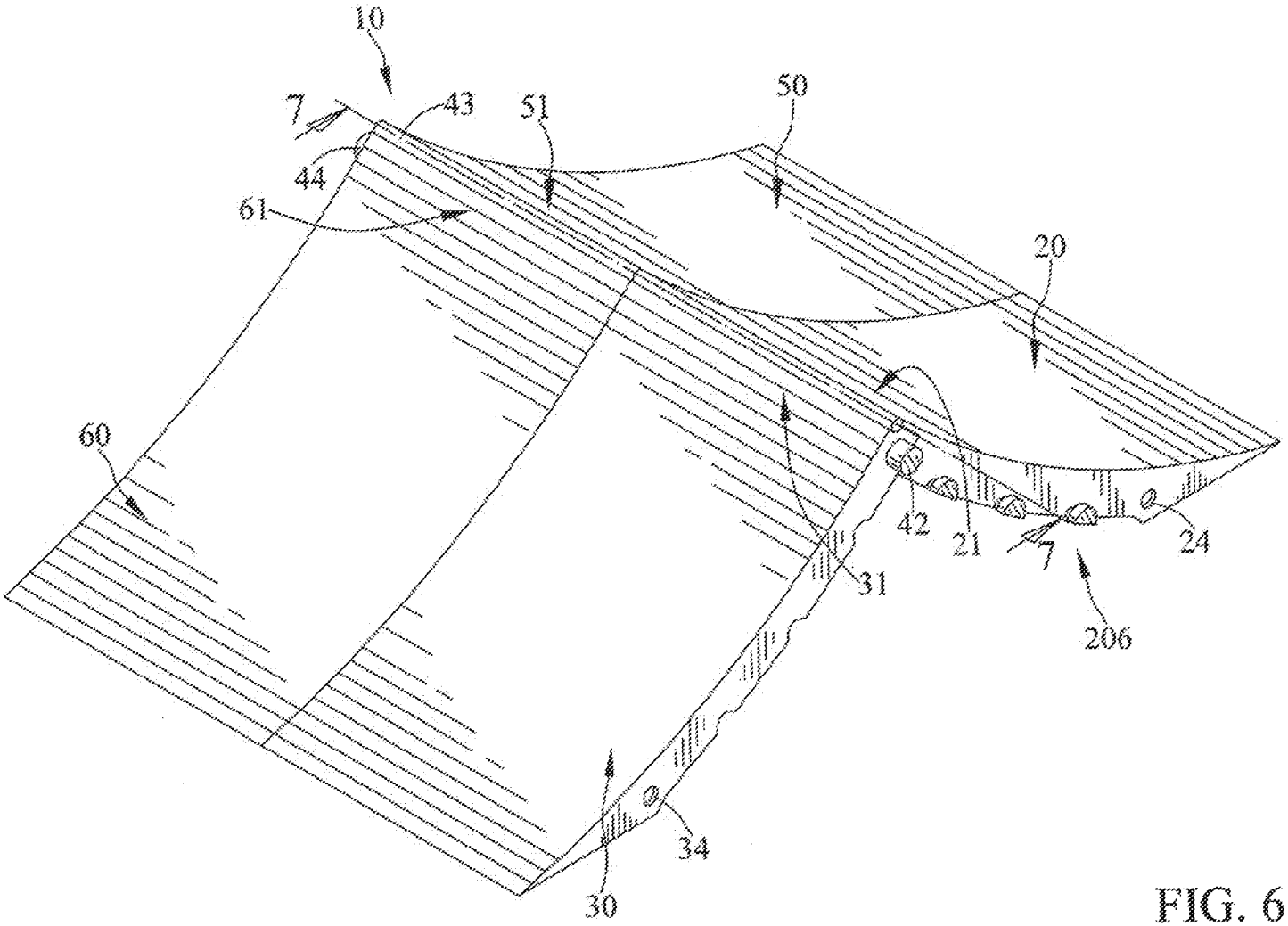
FIG. 6 shows a perspective view of the ramp system of FIG. 3 and illustrates third and fourth ramp components respectively connected with the first and second ramp components.
Figure 7:
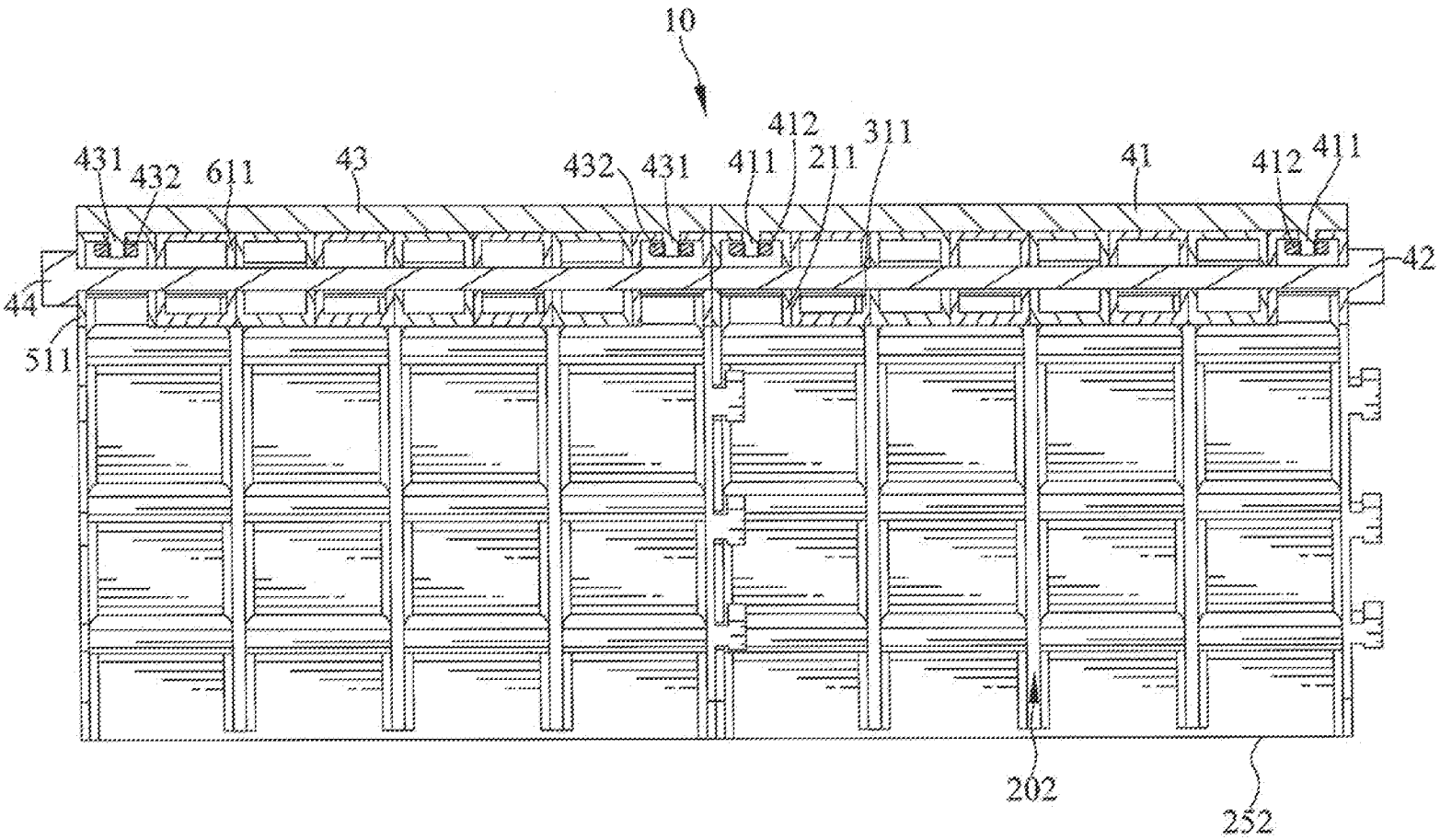
FIG. 7 shows a cross-sectional view taken alone line 7-7 of the ramp system in FIG. 6.
Figure 8:
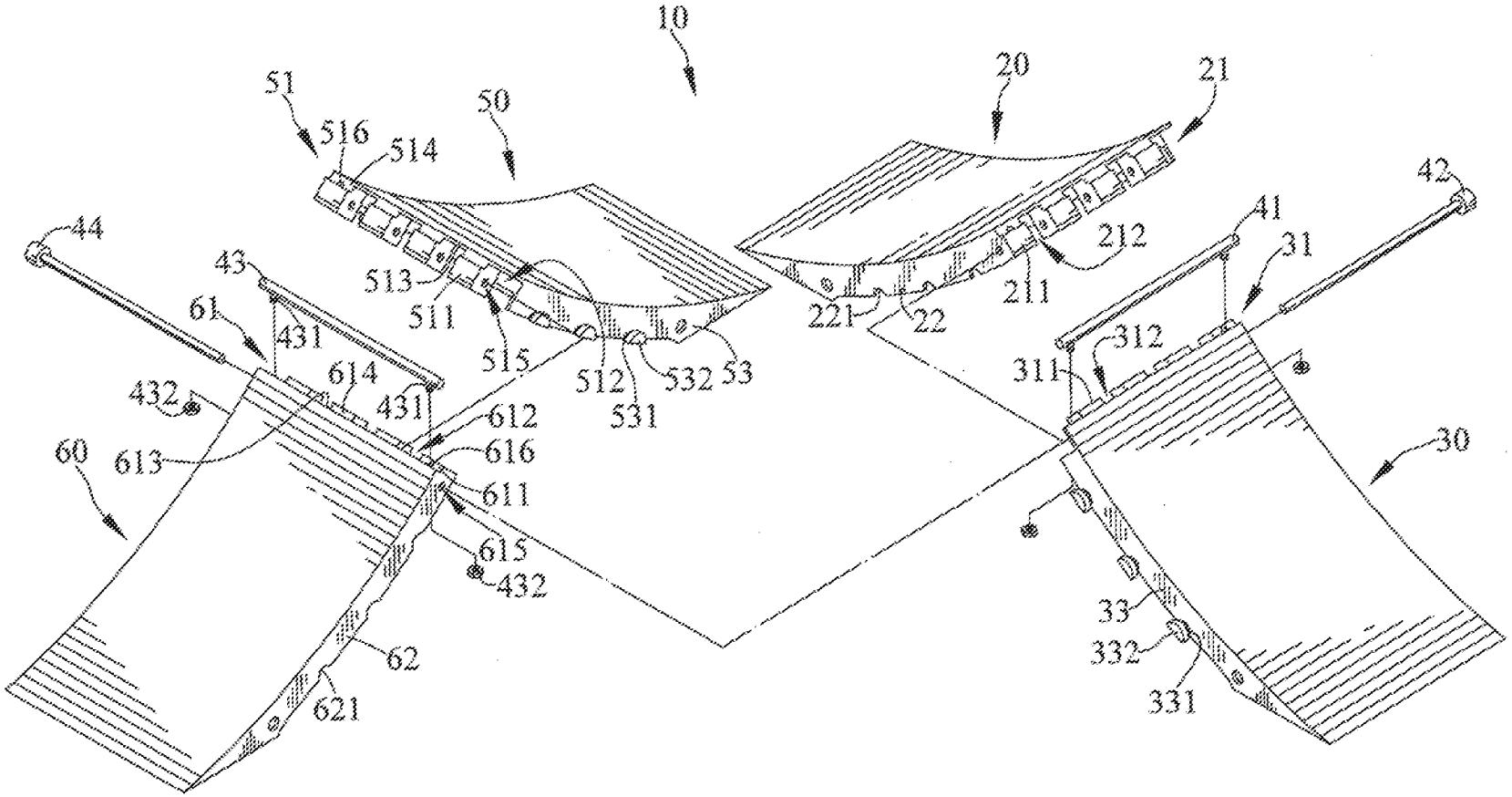
FIG. 8 shows an exploded, perspective view of the ramp system of FIG. 6.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms “first”, “second”, “third”, “fourth”, “end”, “portion”, “longitudinal”, “radial”, “diameter”, “width”, “thickness”, and similar terms are used herein, it should be understood that these terms have reference only to the structure shown in the drawings as it would appear to a person viewing the drawings and are utilized only to facilitate describing the illustrative embodiments.

DETAILED DESCRIPTION OF PREFERRED EMBODIMENT

FIGS. 1 through 8 show a ramp system according to the present invention is shown in the drawings. The ramp system 10 includes a first ramp component 20. The first ramp component 20 provides a curved slope or ramp and includes a front surface 201 provided a user sliding thereon and a back surface 202 opposite to the front surface 201 and facing to the ground. The first ramp component 20 further includes a first end 203 adapted for standing on the ground and a second end 204 opposite to the first end 203. The first ramp component 20 further includes first and second side ends 205 and 206 respectively extending between the first and second ends 203 and 204. The first ramp component 20 has a connecting portion 21 at the second end 204. The connecting portion 21 includes at least one connecting block 211 and at least one connecting recess 212 spaced by the connecting block 211. The at least one connecting block 211 and the at least one connecting recess 212 are alternately arranged at the second end 204 and extended from the first side end 205 to the second side end 206. In the preferred embodiment of the present invention, the at least one connecting block 211 includes four connecting blocks 211, and the at least one connecting recess 212 whose number are the same as that of the connecting blocks 211. The cross sections of the each connecting block 211 and the each connecting recess 212 are substantially square. Each of the four connecting blocks 211 is defined a first width W1, and each of the four connecting recesses 212 is defined a second width W2 equal to the first width W1. Each of the four connecting recesses 212 has an abutting surface 213 adjacent and connected to the front surface 201, and each of the four connecting blocks 211 has an groove 214 adjacent and connected to the front surface 201. The connecting portion 21 further includes a through hole 215 and a longitudinal hole 216 extending perpendicular to the through hole 215. The through hole 215 runs through the four connecting blocks 211. The longitudinal hole 216 is formed through the groove 214 of one of the four connecting blocks 211 which is adjacent to the first side end 205. The first ramp component 20 further includes first and second side walls 22 and 23 respectively formed at the first and second side ends 205 and 206. The first side wall 22 has a plurality of engaging holes 221. The second side wall 23 has a plurality of convex portions 231 extending outwards therefrom. The cross sections of the each of the plurality of engaging holes 221 and the each of the plurality of convex portions 231 are semicircle. In the preferred embodiment of the present invention, the plurality of engaging holes 221 includes three engaging holes 221, and the plurality of convex portions 231 whose number are the same as that of the engaging holes 221. The each of the plurality of convex portions 231 has an outstanding width equal to a width of the first side wall 22. The each of the plurality of convex portions 231 has an engaging section 232 formed at a terminal end thereof. The engaging section 232 is formed in a semicircle and has a radius larger than a radius of the engaging hole 221. The first ramp component 20 further includes an assembling hole 24 running through the first and second side walls 22 and 23. The front and back surfaces 201 and 202 form an included angle 225 less than 30 degree at the first end 203. A contact edge 251 is formed between the front and back surfaces 201 and 202. A contact surface 252 is formed at the first end 203 and adjacent the back surface 202. The contact edge 251 and the contact surface 252 are adapted for abutting the ground.

The ramp system 10 further includes a second ramp component 30 assembled with the first ramp component 20. The structure of the second ramp component 30 is the same as the first ramp component 20. The connecting portion 21 of the first ramp component 20 is connected with a connecting portion 31 of the second ramp component 30. The four connecting blocks 211 of the first ramp component 20 are respectively engaged with four connecting recesses 312 of the second ramp component 30 and abutted against four abutting surface 313 of the second ramp component 30. Likewise, four connecting blocks 311 of the second ramp component 30 are respectively engaged with four connecting recesses 212 of the first ramp component 20 and abutted against the four abutting surface 213 of the first ramp component 20. The through hole 215 of the first ramp component 20 and a through hole 315 of the second ramp component 30 are aligned and communicated with each other. The four grooves 214 of the first ramp component 20 are connected with four grooves 314 of the second ramp component 30.

The ramp system 10 further includes a first spine 41 and a first rod 42. The first spine 41 has two latches 411 extending vertically therefrom and two first fixing members 412 selectively engaging with the two latches 411. The first spine 41 is received into the grooves 214 and 314 of the first and second ramp components 20 and 30. The two latches 411 of the first spine 41 respectively pass through the longitudinal holes 216 and 316 of the first and second ramp components 20 and 30, and the two first fixing members 412 threadly engage with the two latches 411 to cause the first spine 41 securely connected with the first and second ramp components 20 and 30. The first rod 42 passes through the through holes 215 and 315. The first spine 41 is adapted for the user performing trick skating thereon.

The ramp system 10 further includes third and fourth ramp components 50 and 60. The structures of the third and fourth ramp components 50 and 60 are the same as the first ramp component 20. A connecting portion 51 of the third ramp component 50 is connected with a connecting portion 61 of the fourth ramp component 60. Four connecting blocks 511 of the third ramp component 50 are respectively engaged with four connecting recesses 612 of the fourth ramp component 60 and abutted against four abutting surface 613 of the fourth ramp component 60. Likewise, four connecting blocks 611 of the fourth ramp component 60 are respectively engaged with four connecting recesses 512 of the third ramp component 30 and abutted against the four abutting surface 513 of the third ramp component 50. A through hole 515 of the third ramp component 50 and a through hole 615 of the fourth ramp component 60 are aligned and communicated with each other. Four grooves 514 of the third ramp component 50 are connected with four grooves 614 of the fourth ramp component 60.

The ramp system 10 further includes a second spine 43 and a second rod 44. The second spine 43 has two latches 431 extending vertically therefrom and two first fixing members 432 selectively engaging with the two latches 431. The second spine 43 is received into the grooves 514 and 614 of the third and fourth ramp components 50 and 60. The two latches 431 of the second spine 43 respectively pass through longitudinal holes 516 and 616 of the third and fourth ramp components 50 and 60, and the two first fixing members 432 threadly engage with the two latches 431. The second rod 44 passes through the through holes 515 and 615. The second spine 43 is adapted for the user performing trick skating thereon.

A plurality of convex portions 531 of the third ramp component 50 is respectively engaged with the plurality of engaging holes 221 of the first ramp component 20. Each engaging section 532 of the convex portions 511 of the third ramp component 50 abuts against an inner part of the first side wall 22 of the first ramp component 20 to cause a second side wall 53 of the third ramp component 50 abutting against the second side walls 22 of the first ramp component 20. A plurality of convex portions 331 of the second ramp component 30 is respectively engaged with a plurality of engaging holes 621 of the fourth ramp component 60. Each engaging section 332 of the convex portions 331 of the third second component 30 abuts against an inner part of the first side wall 62 of the fourth ramp component 60 to cause a second side wall 33 of the second ramp component 30 abutting against the second side walls 62 of the fourth ramp component 60.

Figure 9:
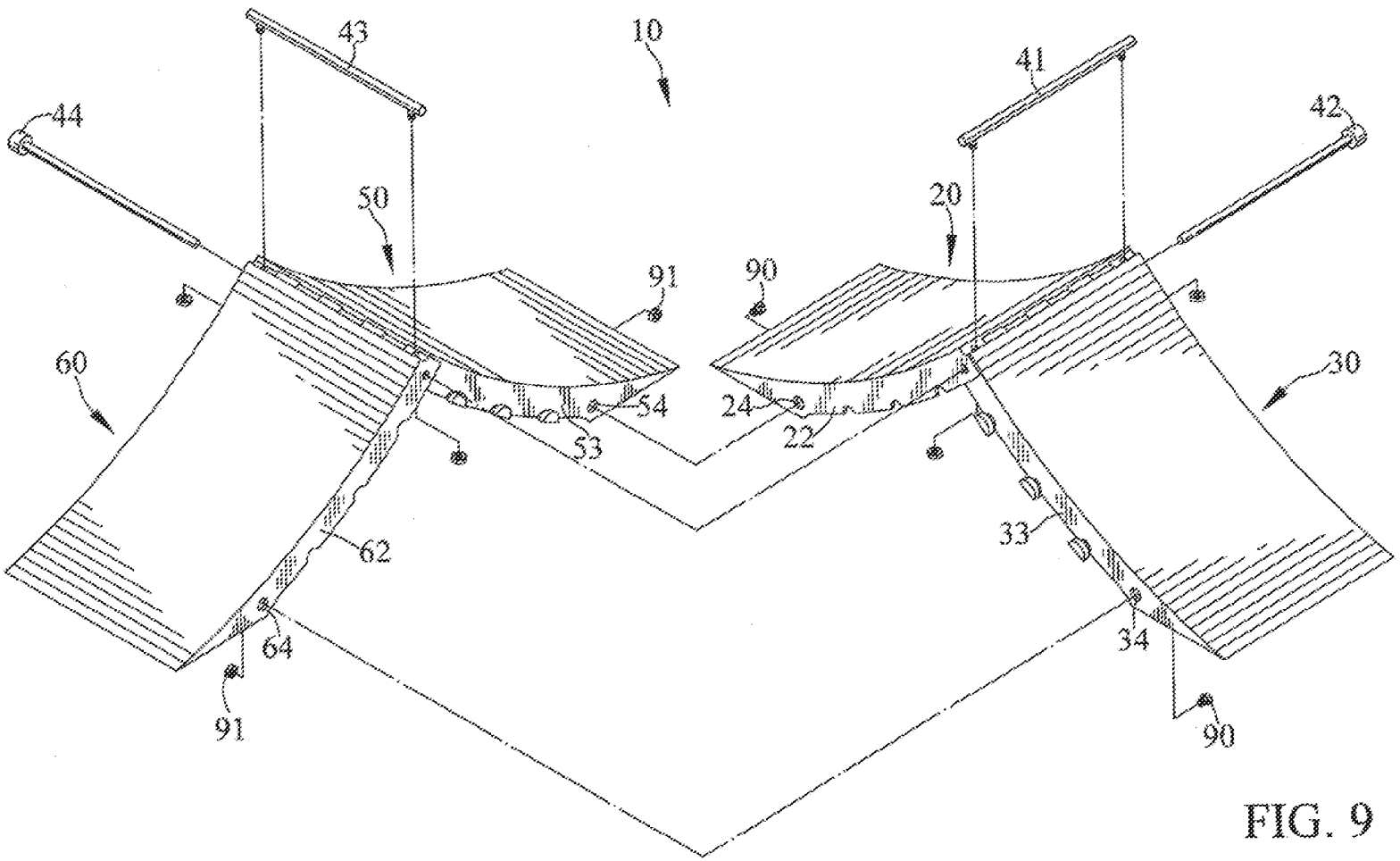
FIG. 9 shows an exploded, perspective view of the ramp system of FIG. 6, and illustrates two fasteners passing through the first and second ramp components and respectively engaging with two second fixing members.
Figure 10:
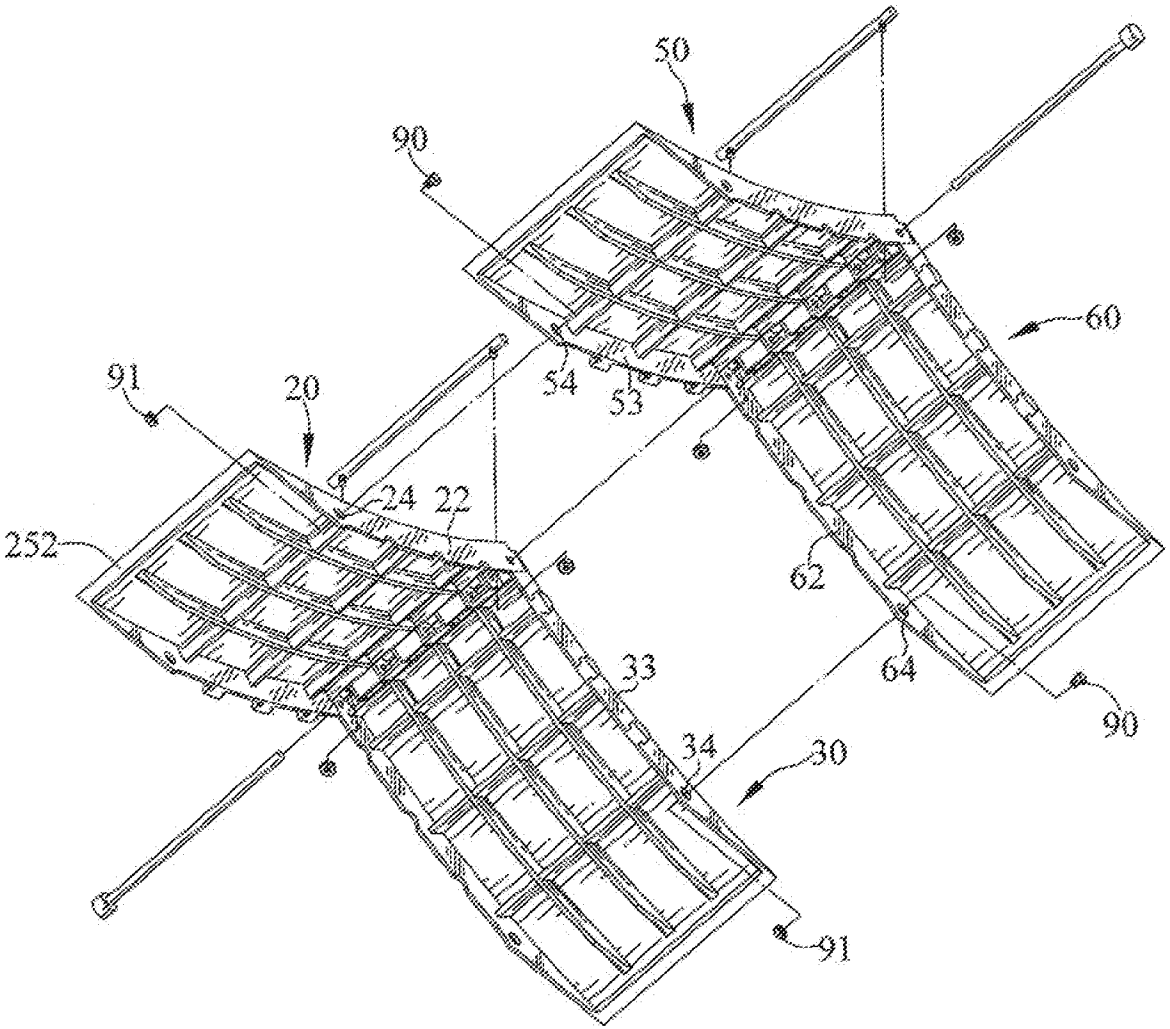
FIG. 10 shows another exploded, perspective view of the ramp system of FIG. 9.
Figure 11:
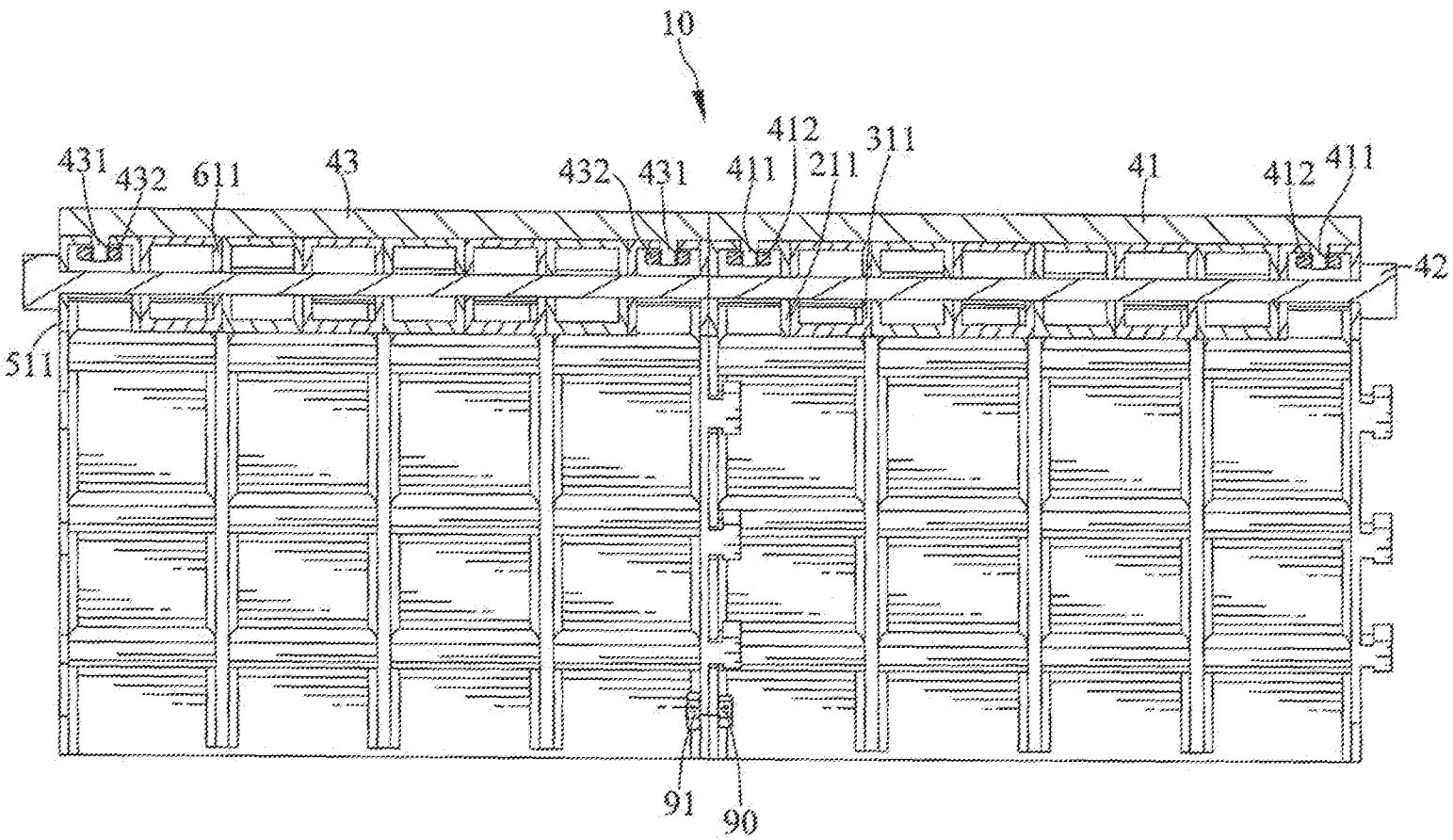
FIG. 11 shows a cross-sectional view of the ramp system and illustrates the fastener passing through the first and third ramp components and engaging with the second fixing member.

Referencing FIGS. 9 and 11, one fastener 90 passes through the assembling hole 24 of the first ramp component 20 and an assembling hole 54 of the third ramp component 50 and engages with one second fixing member 91. Another fastener 90 passes through the assembling hole 34 of the second ramp component 30 and an assembling hole 64 of the fourth ramp component 60 and engages with another second fixing member 91. Therefore, the second side walls 53 and 33 of the third and second ramp components 50 and 30 closely abut against the second side walls 22 and 62 of the first and fourth ramp components 20 and 60 to provide high connection strength between the first, second, third, and fourth ramp components 20, 30, 50, and 60.

The ramp system 10 includes the following advantages:

1. The ramp components 20, 30, 50, and 60 may be releasably assembled together in a variety of ways to create a skating facility. These ramp components 20, 30, 50, and 60 are easily assembled for use and disassembled for storage and transport.

2. The ramp components 20, 30, 50, and 60 are made with a modular design thereby causing efficient manufacturing operation and reducing manufacturing cost.

3. The ramp components 20, 30, 50, and 60 provide a curved slope or ramp and respectively include a surface provided a user sliding thereon, and the spines 41 and 42 are respectively received into the grooves 214, 314, 514, and 614 of the ramp components 20, 30, 50, and 60 and adapted for the user performing a variety of tricks thereon.

4. The plurality of convex portions 231, 331, and 531 and the plurality of engaging holes 221 and 621 of the ramp components 20, 30, 50, and 60 selectively engage together to allow a plurality of ramp components 20, 30, 50, and 60 to be assembled together side-to-side to create a wider ramp system 10 for users.

5. The ramp components 20, 30, 50, and 60 connect together by fasteners 90 and second fixing members 91 to provide high connection strength.

Now that the basic teachings of the ramp system 10 have been explained, many extensions and variations will be obvious to one having ordinary skill in the art. For example, the ramp components 20, 30, 50, and 60, the rails 41 and 42, and the rods 42 and 44 can have shapes different from those shown in the figures and those illustrated.

Thus since the illustrative embodiments disclosed herein may be embodied in other specific forms without departing from the spirit or general characteristics thereof, some of which forms have been indicated the embodiment described herein is to be considered in all respects illustrative and not restrictive. The scope is to be indicated by the appended claims, rather than by the foregoing description, and all changes which come within the meaning and range of equivalency of the claims are intended to be embraced therein.

What is claimed is:

1. A ramp system, comprising:

at least one ramp component each including a curved slope, a front surface provided a user sliding thereon and a back surface opposite to the front surface and facing to the ground, with the at least one ramp component each including a first end adapted for standing on the ground and a second end opposite to the first end, with first and second side ends respectively extending between the first and second ends, with the at least one ramp component each having a connecting portion at the second end, wherein the connecting portion includes at least one connecting block, at least one connecting recess spaced by the connecting block, a through hole, and a longitudinal hole extending perpendicular to the through hole, with the at least one connecting block and the at least one connecting recess alternately arranged and extended from the first side end to the second side end, with the at least one connecting block each having a groove adjacent and connected to the front surface, with the at least one connecting recess each has an abutting surface adjacent and connected to the front surface, with the through hole running through the at least one connecting block, with the longitudinal hole formed through the groove adjacent to the first side end, with the front and back surfaces forming an included angle at the first end, with a contact edge formed between the front and back surfaces, with a contact surface formed at the first end and adjacent the back surface and adapted for abutting the ground.

2. The ramp system as claimed in claim 1, wherein the at least one ramp component includes first and second ramp components, with the connecting portion of the first ramp component connected with the connecting portion of the second ramp component.

3. The ramp system as claimed in claim 2, wherein the at least one connecting block of the first ramp component is engaged with the at least one connecting recess of the second ramp component and abutted against the at least one abutting surface of the second ramp component, with the at least one connecting block of the second ramp component engaged with the at least one connecting recess of the first ramp component and abutted against the at least one abutting surface of the first ramp component.

4. The ramp system as claimed in claim 3, wherein the through hole of the first ramp component and the through hole of the second ramp component are aligned and communicated with each other, with the groove of the first ramp component is connected with the groove of the second ramp component.

5. The ramp system as claimed in claim 4, wherein a spine is received in the grooves of the first and second ramp components, with the spine having two latches extending vertically therefrom, with the two latches of the spine respectively passing through the longitudinal holes of the first and second ramp components, with two fixing members engaging with the two latches, with a rod passing through the through holes.

6. A ramp system, comprising at least one ramp component each including a curved slope, a front surface provided a user sliding thereon and a back surface opposite to the front surface and facing to the ground, with the at least one ramp component each including a first end adapted for standing on the ground and a second end opposite to the first end, with first and second side ends respectively extending between the first and second ends, with the at least one ramp component each having a connecting portion at the second end, with the connecting portion including at least one connecting block and at least one connecting recess spaced by the connecting block, with the at least one connecting block and the at least one connecting recess alternately arranged and extended from the first side end to the second side end, with the front and back surfaces forming an included angle at the first end, with a contact edge formed between the front and back surfaces, with a contact surface formed at the first end and adjacent the back surface and adapted for abutting the ground, with the at least one ramp component further including first and second side walls respectively formed at the first and second side ends, with the first side wall having a plurality of engaging holes, with the second side wall having a plurality of convex portions extending outwards therefrom, with the each of the plurality of convex portions having an engaging section formed at a terminal end thereof, with an assembling hole running through the first and second side walls.

7. The ramp system as claimed in claim 6, wherein cross sections of the each of the plurality of engaging holes, the each of the plurality of convex portions, and the each of the engaging sections are semicircle, with the engaging section defined a radius larger than that of the engaging hole and the convex portion.

8. The ramp system as claimed in claim 6, wherein the at least one ramp component includes first and second ramp components, with the plurality of convex portions of the second ramp component respectively engaged with the plurality of engaging holes of the first ramp component, with the each of the plurality of engaging sections of the plurality of convex portions of the second ramp component abutting against an inner part of the first side wall of the first ramp component to cause a second side wall of the second ramp component abutting against the second side walls of the first ramp component.

9. The ramp system as claimed in claim 8, wherein a fastener passes through the assembling holes of the first and second ramp components and engages with a fixing member, with the second side wall of the second ramp component closely abutting against the second side wall of the first ramp components.

10. The ramp system as claimed in claim 6, wherein the at least one connecting block is defined a first width, wherein the at least one connecting recess is defined a second width equal to the first width.

11. The ramp system as claimed in claim 6, wherein cross sections of the at least one connecting block and the at least one connecting recess are square shaped.

12. The ramp system as claimed in claim 6, wherein the included angle is less than 30 degree.

* * * * *